US005119140A

United States Patent [19]

Berkes et al.

[11] Patent Number: 5,119,140

[45] Date of Patent: Jun. 2, 1992

[54] PROCESS FOR OBTAINING VERY HIGH TRANSFER EFFICIENCY FROM INTERMEDIATE TO PAPER

[75] Inventors: John S. Berkes, Webster; Frank J. Bonsignore, Rochester, both of N.Y.

[73] Assignee: Xerox Corporation, Stamford, Conn.

[21] Appl. No.: 724,283

[22] Filed: Jul. 1, 1991

[51] Int. Cl.[5] ..... G03G 15/16

[52] U.S. Cl. ..... 355/273; 355/271; 355/326; 430/33

[58] Field of Search ..... 355/273, 274, 326, 327, 355/244, 271; 430/33, 97

[56] References Cited

U.S. PATENT DOCUMENTS 3,893,761 7/1975 Buchan et al. ..... 355/3 R
3,957,367 5/1974 Goel ..... 355/4
4,341,455 7/1982 Fodder ..... 355/3 TR
4,435,067 3/1984 Draai et al. .
4,455,079 6/1984 Miwa et al. .
4,518,976 5/1985 Tarumi et al. .
4,682,880 7/1987 Fujii et al. ..... 355/4
4,690,539 9/1987 Radulski et al. .
4,705,385 11/1987 Palm et al. .
4,708,460 11/1987 Langdon .
4,743,939 5/1988 Dulmage et al. .
4,755,849 9/1988 Tarumi et al. .
4,796,048 1/1989 Bean .
4,984,026 1/1991 Nishise et al. ..... 355/271 X
4,992,833 2/1991 Derimiggio ..... 355/271 X
5,012,290 4/1991 Berkes et al. ..... 355/271
5,038,177 8/1991 Parker et al. ..... 355/273
5,053,829 10/1991 Tompkins et al. ..... 355/271

*Primary Examiner*—R. L. Moses

[57] ABSTRACT

Method and apparatus wherein very efficient transfer of low toner masses from an intermediate image receiving member without degradation of high toner mass transfer is effected by using a DC pretransfer corotron treatment of the toner on the intermediate followed by biased roll transfer to plain paper.

20 Claims, 2 Drawing Sheets

PROCESS FOR OBTAINING VERY HIGH TRANSFER EFFICIENCY FROM INTERMEDIATE TO PAPER

BACKGROUND OF THE INVENTION

The present invention is directed to an imaging method and apparatus and, in particular, it is directed to an imaging method and apparatus wherein electrostatic latent images are formed on imaging members where they are rendered visible with toner particles, followed by transfer of the toner images to an intermediate transfer member followed by transfer with very high efficiency to a permanent substrate.

Imaging processes wherein a developed image is first transferred to an intermediate transfer means and subsequently transferred from the intermediate transfer means to a substrate are known. For example, U.S. Pat. No. 3,862,848 (Marley), discloses an electrostatic method for the reproduction of printed matter in which an electrostatic latent image is developed by the attraction of electroscopic marking particles thereto and is then transferred to a first receptor surface by the simultaneous application of contact and a directional electrostatic field of a polarity to urge the marking particles to the receptor surface, with the image then being transferred from the first receptor surface to a second receptor surface by the simultaneous application of contact and a directional electrostatic field of opposite polarity to urge the marking particles to the second receptor surface.

In addition, U.S. Pat. No. 3,957,367 (Goel), discloses a color electrostatographic printing machine in which successive single color powder images are transferred, in superimposed registration with one another, to an intermediary. The multi-layered powder image is fused on the intermediary and transferred therefrom to a sheet of support material, forming a copy of the original document.

Further, U.S. Pat. No. 4,341,455 (Fedder), discloses an apparatus for transferring magnetic and conducting toner from a dielectric surface to plain paper by interposing a dielectric belt mechanism between the dielectric surface of an imaging drum and a plain paper substrate such that the toner is first transferred to the dielectric belt and subsequently transferred to a plain paper in a fusing station. The dielectric belt is preferably a material such as Teflon or polyethylene to which toner particles will not stick as they are fused in the heat-fuser station.

U.S. Pat. No. 3,893,761 (Buchan et al.), discloses an apparatus for transferring non-fused xerographic toner images from a first support material, such as a photoconductive insulating surface, to a second support material, such as paper, and fusing the toner images to the second support material. Such apparatus includes an intermediate transfer member having a smooth surface of low surface free energy below 40 dynes per centimeter and a hardness of from 3 to 70 durometer. The intermediate transfer member can be, for example, a 0.1 to 10 mil layer of silicone rubber or a fluoroelastomer coated onto a polyimide support. The member can be formed into belt or drum configuration. Toner images are transferred from the first support material to the intermediate transfer member by any conventional method, preferably pressure transfer. The toner image is then heated on the intermediate transfer member to at least its melting point temperature, with heating preferably being selective. After the toner is heated, the second support material is brought into pressure contact with the hot toner whereby the toner is transferred and fused to the second support material.

U.S. Pat. No. 4,682,880 (Fujii et al.), discloses a process wherein an electrostatic latent image is formed on a rotatable latent image bearing member and is developed with a developer into a visualized image. The visualized image is transferred by pressure to a rotatable visualized image bearing member. The steps are repeated with different color developers to form on the same visualized image bearing member a multi-color image which corresponds to one final image to be recorded. The latent image bearing member and the visualized image bearing member form a nip therebetween through which a recording material is passed so that the multi-color image is transferred all at once to a recording material.

"Color Xerography With Intermediate Transfer," J. R. Davidson, Xerox Disclosure Journal, volume 1, number 7, page 29 (Jul. 1976), the disclosure of which is incorporated herein by reference, discloses a xerographic development apparatus for producing color images. Registration of the component colors is improved by the use of a dimensionally stable intermediate transfer member. Component colors such as cyan, yellow, magenta, and black are synchronously developed onto xerographic drums and transferred in registration onto the dimensionally stable intermediate transfer member. The composite color image is then transferred to a receiving surface such as paper. The intermediate transfer member is held in registration at the transfer station for transferring images from the xerographic drums to the member by a hole-and-sprocket arrangement, wherein sprockets on the edges of the drums engage holes in the edge of the intermediate transfer member.

U.S. patent application Ser. No. 07/513,406 filed on Apr. 23, 1990 in the name of Berkes et al and assigned to the same assignee as the instant application discloses an imaging apparatus and process wherein an electrostatic latent image is formed on an imaging member and developed with a toner, followed by transfer of the developed image to an intermediate transfer element and subsequent transfer with very high transfer efficiency of the developed image from the intermediate transfer element to a permanent substrate, wherein the intermediate transfer element has a charge relaxation time of no more than about $2\times10^2$ seconds.

Intermediate transfer elements employed in imaging apparatuses in which a developed image is first transferred from the imaging member to the intermediate and then transferred from the intermediate to a substrate should exhibit both good transfer of toner material from the imaging member to the intermediate and very good transfer of toner material from the intermediate to the substrate. Very good transfer occurs when most or all of the toner material comprising the image is transferred and little residual toner remains on the surface from which the image was transferred. Very good transfer is particularly important when the imaging process entails generating full color images by sequentially generating and developing images in each primary color in succession and superimposing the primary color images onto each other on the intermediate, since undersirable shifting or color deterioration in the final colors obtained can occur when the primary color images are not efficiently transferred from the intermediate to the substrate (paper).

Although known methods and materials are suitable for their intended purposes, a need remains for imaging apparatuses and methods employing intermediate transfer elements with high transfer efficiency to a final substrate. In addition, there is a need for imaging apparatuses and methods employing intermediate transfer elements that enable generation of full color images with high color fidelity.

BRIEF SUMMARY OF THE INVENTION

The present invention discloses a tandem color printing apparatus and method wherein efficient transfer of toner images over a broad toner mass range (i.e. 0 to 3 $mg/cm^2$) from an intermediate to plain paper is accomplished. Known methods of toner image transfer, for example, Biased Roll Transfer (BTR) provide for efficient transfer of high toner mass images from an intermediate to paper but are highly inefficient in the transfer of low toner mass images.

Xerographic color copiers or printers which use tandem engines with an intermediate have a tremendous advantage in high throughput for modest process speeds. A further advantage can be found in simpler paper handling requirements. The main disadvantage is that a plurality of transfer steps are required. The last transfer step is especially critical in that a very high and uniform transfer efficiency needs to be maintained over an extremely broad toner mass range (0 to 3 $mg/cm^2$) to preclude color shifting. Color shifting refers to color deterioration due to incomplete toner transfer.

In the process of transferring a plurality of images from separate imaging structures to an intermediate, a high percentage of wrong sign toner is created with a particularly high proportion of wrong sign toner for low toner masses. This is due to the air breakdown phenomenon occurring during stripping of the intermediate from the individual imaging structures. Each time stripping occurs more toner is converted to the wrong sign. The high percentage of wrong sign toner results in the problem of inefficient transfer of low mass toner images from the intermediate to the final substrate, plain paper.

High toner transfer efficiency of low toner masses without degradation of high toner mass transfer efficiency is effected according to the present invention, by using a DC pretransfer corotron treatment of the toner on the intermediate followed by biased roll transfer to plain paper.

DETAILED DESCRIPTION OF THE PREFERRED EMBODIMENT OF THE INVENTION

Figure 1:
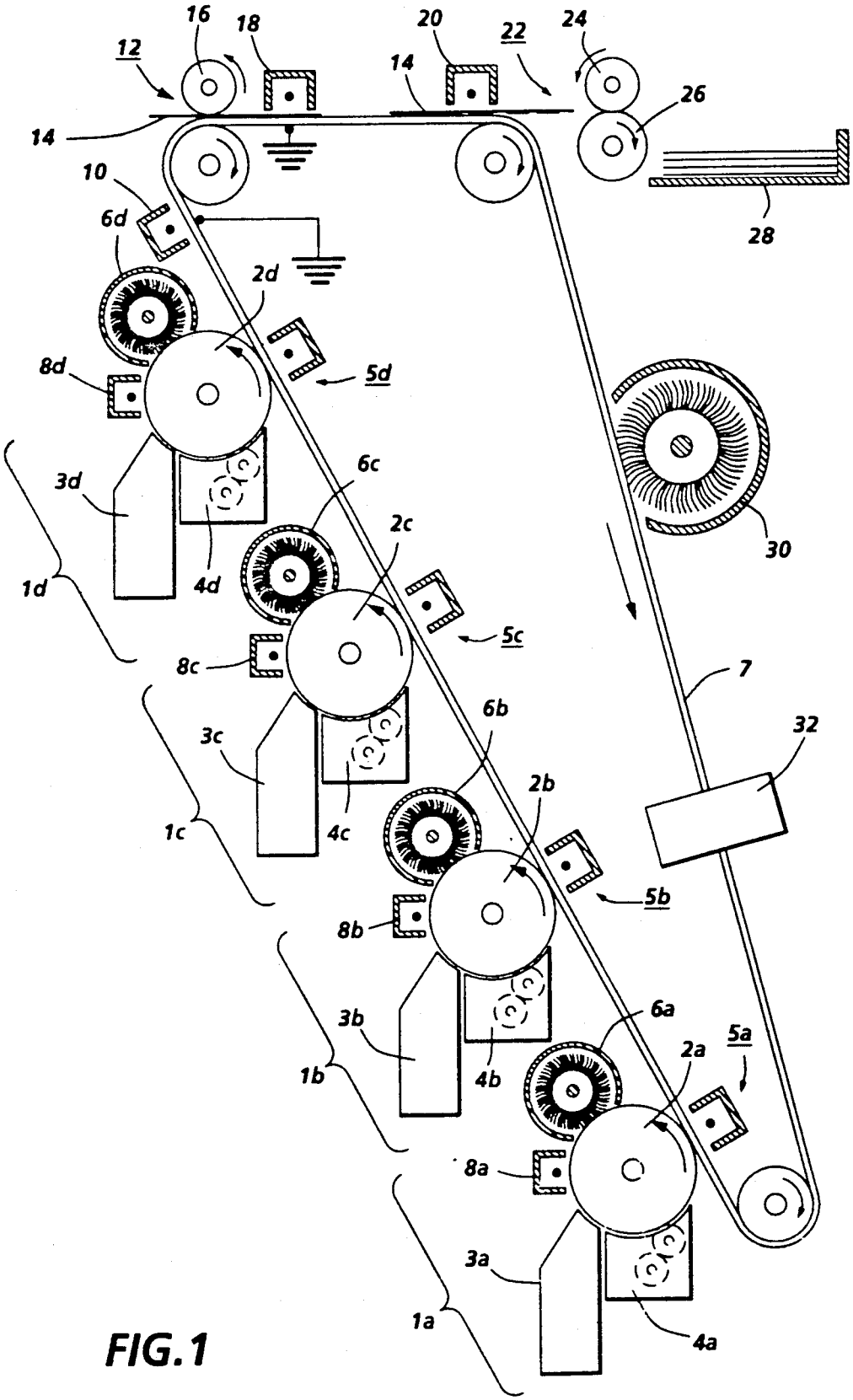
FIG. 1 is schematic illustration of a color printing apparatus incorporating the inventive features of the invention.

Although specific terms are used in the following description for the sake of clarity, these terms are intended to refer only to the particular structure of the invention selected for illustration in the drawings, and are not intended to define or limit the scope of the invention. A typical color printing apparatus in which the present invention may be used is illustrated in the Figure.

In dry electrophotographic printing machines, multicolor copying has been achieved with the utilization of an intermediate roller. In devices of this type, successive toner powder images are transferred, in superimposed registration with one another, from the photoconductive drum to an intermediate roller. One such system is described in U.S. Pat. No. 3,957,367 issued to Goel in 1976 which is herein incorporated by reference. In this system, successive toner powder images are transferred from the photoconductive surface to an intermediate roller in superimposed registration with one another. The multicolored image is then transferred to the copy sheet.

In the color electrophotographic apparatus of the present invention, as shown in the Figure, four image forming devices 1*a*, 1*b*, 1*c* and 1*d* are utilized. The image forming devices each comprise an image receiving member in the form of photosensitive drum or photoreceptor 2*a*, 2*b*, 2*c*, or 2*d* about which are positioned the image forming components of the imaging structure. The image receiving members are supported for rotation in the direction of the arrows as shown. The image forming devices further comprise exposure structures 3*a*, 3*b*, 3*c* and 3*d*, developing structures 4*a*, 4*b*, 4*c* and 4*d*, transfer structures 5*a*, 5*b*, 5*c* and 5*d*, cleaning structures 6*a*, 6*b*, 6*c* and 6*d* and finally charging structures 8*a*, 8*b*, 8*c* and 8*d*. An intermediate image receiver 7, such as an endless belt, is supported for movement in an endless path such that incremental portions thereof move past the image forming devices 1*a*, 1*b*, 1*c* and 1*d* for transfer of an image from each of the image receiving members 2*a*, 2*b*, 2*c* and 2*d*. Each image forming device 1*a* through 1*d* is positioned adjacent intermediate belt 7 for enabling transfer of different color toner images to intermediate belt 7 in superimposed registration with one another. The belt 7 is preferably fabricated from clear Tedlar# (Trademark of E.I. duPont de Nemours & Co for a polyvinylfluoride film) or carbon loaded Tedlar or pigmented Tedlar.

The exposure structures 3*a* through 3*d* may be any type of rastor input/output scanning device (RIS/ROS) or any combination using the RIS/ROS devices. The preferred embodiment uses a two-level ROS device incorporating a laser. The ROS is a moving spot system that exposes the photoreceptors 2*a* through 2*d* to a light intensity at two levels. Generally, a laser is the light source since it produces a collimated light bean suited for focusing to a small spot, yet with adequate energy to effectively discharge the photoconductors 2*a* through 2*d* which have been previously uniformly charged using the the charging structures 8*a* through 8*d*. Charging structures 8*a* through 8*d* may comprise conventional corona discharge devices. The sweep or moving action of the spot is typically obtained by rotating multifaceted mirrors or by reciprocating mirrors attached to galvanometers. Also, a moving spot can be obtained without mechanical devices such as the galvanometer and rotating mirror. An example of a non-mechanical device is an optical defraction member whose internal defraction or reflection properties are varied electrically. Piezoelectric crystals are examples of such devices. An example of a ROS mechanism includes U.S. Pat. No. 4,236,809, herein incorporated by reference.

The belt 7 moves in the clockwise direction as illustrated by the arrow such that each incremental portion thereof first moves past the imaging forming device 1*a*.

A yellow image component corresponding to the yellow component of a an original is formed on the photosensitive drum 2a using conventional electrophotographic components such as the charging structure 8a, the exposure structure 3a and the developing structure 4a. The developer structure develops a yellow toner image on the photosensitive drum 2a. The drum rotates in the counterclockwise direction and contacts the belt 7 as shown. The transfer structure 5a which may comprise a corona discharge device serves to effect transfer of the yellow component of the image at the area of contact between the photosensitive member 2a and the belt 7. Subsequent to transfer of the yellow image to the belt 7, residual yellow toner is removed from the drum 2a using the cleaning structure 6a.

In like fashion, a magenta image component corresponding to the magenta component of the original image is formed on the photosensitive drum 2b using conventional electrophotographic components such as the charging structure 8b, the exposure structure 3b and the developing structure 4b. The developer structure develops a magneta toner image on the photosensitive drum 2b. The drum rotates in the counterclockwise direction and contacts the belt 7 as shown. The transfer structure 5b which may comprise a corona discharge device serves to effect transfer of the magenta component of the image at the area of contact between the photosensitive member 2b and the belt 7. Subsequent transfer of the magenta image to the belt 7, residual magenta toner is removed from the drum 2b using the cleaning structure 6b.

The cyan and black image components corresponding, respectively to the cyan and black components of the original are formed on the photosensitive drums 2c and 2d, respectively. These images are sequentially transferred to the belt 7 in a superimposed relationship resulting a final toner image comprising three colors plus black. Corona discharge devices 5c and 5d were used for image transfer. After transfer of the cyan and black component images, residual toner is removed from the respective image receiving members by cleaning structures 6c and 6d.

In the process of transferring all four component images from the image receiving units to the intermediate belt 7, a high percentage of wrong sign toner is created with a particularly high proportion of wrong sign toner for low toner masses. This is due to the air breakdown phenomenon occurring during stripping of the intermediate belt from the each of the image receiving members 2a through 2d. Each time stripping occurs more toner is converted to the wrong sign. The high percentage of wrong sign toner results in the problem of inefficient transfer of low mass toner images from the intermediate to the final substrate, plain paper.

Figure 2:
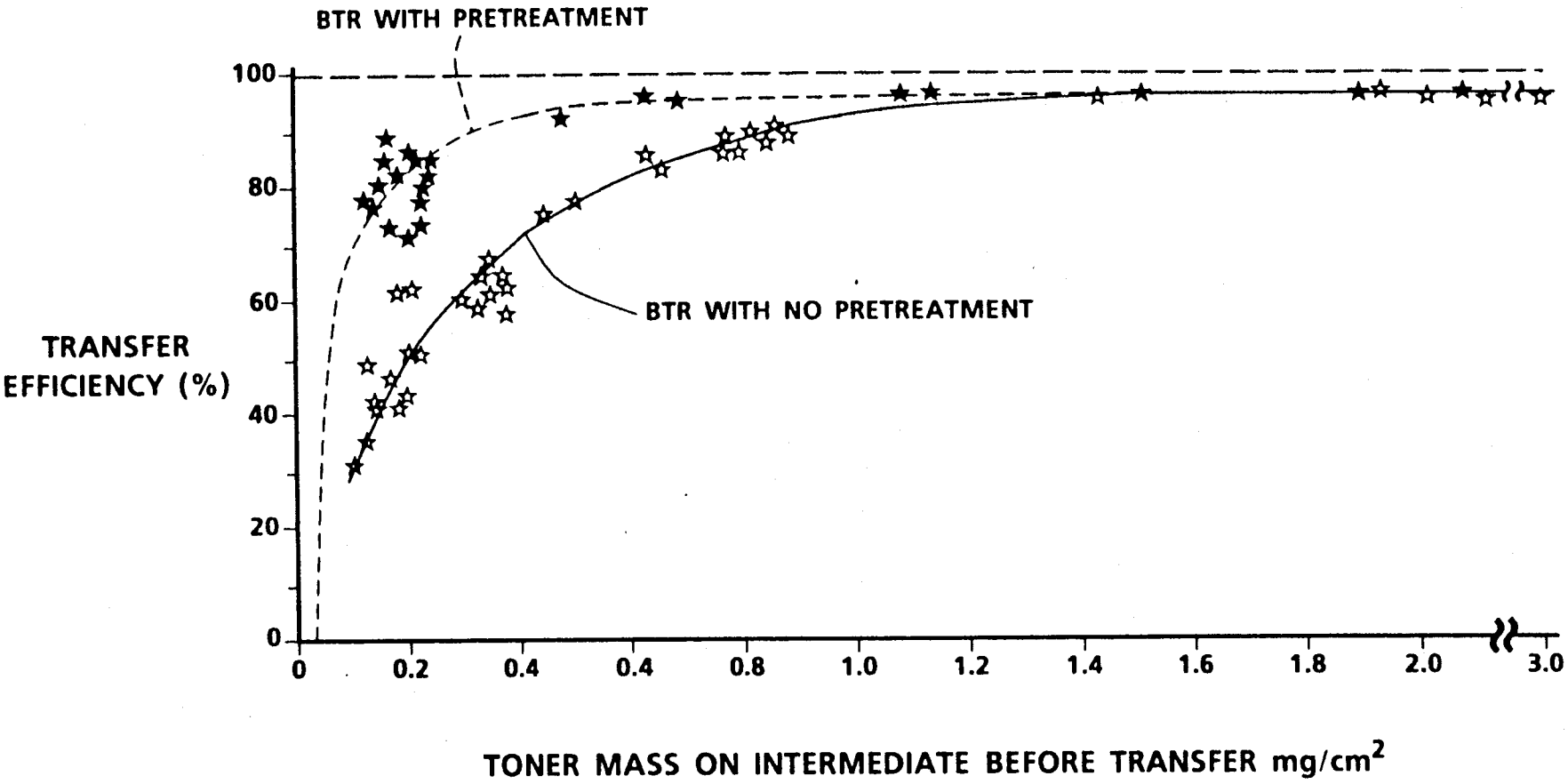
FIG. 2 is a plot of Transfer efficiency versus toner mass on intermediate before transfer for the conditions of BTR transfer with and without image pretreatment.

In order to obviate the aforementioned inefficient transfer problem, the composite toner image on the belt 7 is treated using a DC corona discharge device 10. At a process speed of 4 in/sec a range of pretreatment corona discharge currents in the order of 0 to −5.3 μA/in were tried. A wide latitude with essentially constant results was observed for high toner mass greater 0.8 mg/cm$^2$ as illustrated in the following table showing the fraction of wrong sign toner and its effect on transfer efficiency as a function of toner mass. The table further shows the reduction of wrong sign toner and the increase in transfer efficiency using a pretreatment corotron which is especially pronounced for low (i.e. 0.15 and 0.35 mg/cm$^2$) toner mass. A $TiO_2$ Loaded Tedlar intermediate, run @ 4ips and 20% RH was utilized. This pretreatment serves to greatly reduce the wrong sign toner and shifts the average charge of the toner to make it more negative thereby enabling highly efficient transfer. This effect was reconfirmed in a second set of experiments as shown in FIG. 2. FIG. 2 illustrates the dramatic improvement in the transfer efficiency as a function of toner mass and is especially pronounced at low to intermediate masses. The solid line curve shown in FIG. 2 is for BTR transfer with no pretreatment while the dotted line curve is for BTR transfer with pretreatment. The pretreatment corona discharge from corona device 10 was −4 μA/in with the BTR operated at 0.6 μA/in. The experiment was conducted at a process speed 4 inches per second and RH of 20%.

| Pre-treatment (μA/in) | M/A (mc/cm$^2$) | Transfer (%) | Q/M μc/gm On Paper | Volume Wrong Sign Toner (%) |
|---|---|---|---|---|
| 0 | .13 | 27 | −10.0 | 11.87 |
| 0 | .36 | 55 | −10.4 | 19.53 |
| 0 | .81 | 90 | −13.2 | 6.85 |
| −1.3 | .15 | 57 | −9.5 | 0.35 |
| −1.3 | .35 | 82 | −14.6 | 5.29 |
| −1.3 | .78 | 97 | −20.1 | 1.03 |
| −2.7 | .14 | 71 | −15.8 | 0.78 |
| −2.7 | .37 | 89 | −17.3 | 0.17 |
| −2.7 | .80 | 97 | −22.0 | 0.76 |
| −4.0 | .16 | 72 | −17.1 | 1.84 |
| −4.0 | .38 | 89 | −18.6 | 0.22 |
| −4.0 | .83 | 97 | −21.5 | 5.19 |
| −5.3 | .13 | 81 | −18.0 | 1.47 |
| −5.3 | .34 | 93 | −20.0 | 4.51 |
| −5.3 | .81 | 97 | −21.5 | 1.93 |

Subsequent to corona pretreatment the intermediate 7 is moved through a transfer station 12, where the multicolored image is transferred to a sheet of transfer material or copy sheet 14. A sheet of transfer material 14 is moved into contact with the toner image at transfer station 12. The sheet 14 is advanced to the transfer station 10 by conventional sheet feeding apparatus, not shown. Preferably, sheet feeding apparatus includes a feed roll contacting the upper most sheet of a stack of copy sheets. Feed rollers rotate so as to advance the uppermost sheet from stack into contact with intermediate 7 in a timed sequence so that the toner powder image thereon contacts the advancing sheet at the transfer station 10. At the transfer station 12, a Biased Transfer Roll (BTR) 16 is used to provide good contact between the sheet 14 and the toner image during transfer. A corona transfer device 18 is also provided for assisting the BTR in effecting image transfer. A detack corona device 20 is provided downstream of the corona device 16 for facilitating removal of the sheet 14 from the belt 7.

The sheet 14 carrying the transferred toner image is passed through the nip of a heat and pressure 22. The fuser 22 comprises a heated fuser roller 24 and a backup roller 26. Sheet 14 passes between fuser roller 24 and backup roller 26 with the toner powder image contacting fuser roller 24. In this manner, the toner powder image is permanently affixed to sheet 14. After fusing, a chute, not shown, guides the advancing sheet 14 to a catch tray 28 for subsequent removal from the printing machine by the operator.

After the sheet of support material 14 is separated from belt 7, the residual toner particles on the surface of belt are removed therefrom. These particles are removed by a cleaning apparatus 30 The cleaner apparatus comprises a conventional magnetic brush roll structure for causing carrier particles in the cleaner housing to form a brush-like orientation relative to the roll structure and the Belt 7.

Subsequent to cleaning, discharge device 32 is used to neutralize any residual electrostatic charge remaining on the belt 7 prior to the next imaging cycle.

What is claimed is:

1. Apparatus for forming toner images, said apparatus comprising:

at least one image forming device including an image receiving member;

means for transferring a toner image from said image receiving member to an intermediate image receiving member;

means for transferring said toner image to a final substrate; and means for treating said toner image prior to its transfer to said final substrate whereby low toner mass portions of said image are efficiently transferred to said final substrate without degradation of high toner mass portions of the image.

2. Apparatus according to claim 1 wherein said treating means comprises means for reducing the wrong sign toner of said composite image.

3. Apparatus according to claim 2 including a plurality of image forming devices for creating a plurality of images; and transferring means comprises means for transferring said plurality of images to said intermediate such that they reside on top of the other thereby forming a composite image.

4. Apparatus according to claim 3 wherein said image forming means comprise a plurality of developer structures, each containing a different color toner.

5. Apparatus according to claim 4 wherein said intermediate comprises an endless web.

6. Apparatus according to claim 5 wherein said web is fabricated from a polyvinylfluoride film.

7. Apparatus according to claim 6 wherein said treating means comprises a DC corona discharge device.

8. Apparatus according to claim 7 wherein said means for transferring said composite image to a final substrate comprises a biased transfer roll.

9. Apparatus according to claim 8 including a corona discharge device cooperating with said biased transfer roll for effecting transfer of said composite image to from said intermediate to said final substrate.

10. Apparatus according to claim 9 wherein said final substrate comprises plain paper.

11. Method of forming toner images, said method including the steps of:

forming at least one toner image on an image receiving member;

transferring said at least one toner image to an intermediate member;

treating said at least one toner image for improving transfer of the efficiency of transfer of low toner mass portions of said at least toner image without degrading the transfer of high mass portions of said at least one image; and transferring said at least one toner image to a final substrate.

12. The method according to claim 11 wherein said step of treating is effected using means for reducing the wrong sign toner of said composite image.

13. The method according to claim 12 wherein a plurality of toner images are formed on separate image forming devices and said method includes transferring said plurality of toner images to said intermediate in a superimposed orientation thereby forming a composite image.

14. The method according to claim 13 said plurality of toner images are formed using toners of different colors.

15. The method according to claim 14 wherein said step of transferring to an intermediate comprises transferring to an endless web.

16. The method according to claim 15 wherein said endless web is fabricated from a polyvinylfluoride film.

17. The method according to claim 16 wherein said step of treating is effected with a DC corona discharge device.

18. The method according to claim 17 wherein said step of transferring to a final substrate is effected using a biased transfer roll.

19. The method according to claim 18 including the step of using a corona discharge device to assist said biased transfer roll in transferring said composite toner image to said final support.

20. The method according to claim 19 wherein said final support comprise plain paper.

* * * * *